US009175894B2

(12) United States Patent
Mitchell

(10) Patent No.: US 9,175,894 B2
(45) Date of Patent: Nov. 3, 2015

(54) APPARATUS FOR DISPENSING LIQUIDS AND SOLIDS

(75) Inventor: Alan Joseph Mitchell, Louisville, KY (US)

(73) Assignee: General Electric Company, Schenectady, NY (US)

( * ) Notice: Subject to any disclaimer, the term of this patent is extended or adjusted under 35 U.S.C. 154(b) by 510 days.

(21) Appl. No.: 13/189,892

(22) Filed: Jul. 25, 2011

(65) Prior Publication Data

US 2013/0026184 A1 Jan. 31, 2013

(51) Int. Cl.

| | |
|---|---|
| ***F25D 3/00*** | (2006.01) |
| ***F25C 5/00*** | (2006.01) |
| ***F25D 23/12*** | (2006.01) |

(52) U.S. Cl.

CPC ..... *F25C 5/005* (2013.01); *F25D 23/126* (2013.01); *F25C 2400/10* (2013.01); *F25D 2400/18* (2013.01)

(58) Field of Classification Search

CPC .. B65D 90/582; G01F 11/265; B67D 3/0032; B05C 5/02225; B05C 17/00553; F25C 1/04; F25C 5/005; F25D 23/126; F25D 31/002; A47K 5/10; A47K 5/18; A47J 42/44; A47J 31/404

USPC ..... 222/505, 504, 146.6, 477; 141/351, 141/360, 361, 362, 369; 62/389–390, 340, 62/344

See application file for complete search history.

(56) References Cited

U.S. PATENT DOCUMENTS

| | | | | |
|---|---|---|---|---|
| 3,934,757 | A * | 1/1976 | Malek et al. | 141/362 |
| 4,089,436 | A * | 5/1978 | Marks | 222/504 |
| 4,090,641 | A * | 5/1978 | Lindenschmidt | 222/504 |
| 5,474,213 | A * | 12/1995 | Unger | 222/108 |
| 6,679,082 | B1 * | 1/2004 | Tunzi | 62/344 |
| 7,137,272 | B2 | 11/2006 | Park et al. | |
| 7,445,137 | B2 * | 11/2008 | Noh et al. | 222/477 |
| 7,587,910 | B2 | 9/2009 | Bowen et al. | |
| 7,703,297 | B2 * | 4/2010 | Bowen et al. | 62/344 |
| 7,958,742 | B2 * | 6/2011 | Park et al. | 62/389 |
| 8,146,783 | B2 * | 4/2012 | Oh et al. | 222/504 |
| 8,328,054 | B2 * | 12/2012 | Oh | 222/504 |
| 8,348,108 | B2 * | 1/2013 | Choi | 222/504 |
| 2005/0112040 | A1 * | 5/2005 | Hasegawa | A61B 1/123 422/300 |
| 2006/0131324 | A1 * | 6/2006 | Noh et al. | 221/150 R |
| 2009/0013699 | A1 | 1/2009 | Kim et al. | |
| 2015/0121924 | A1 * | 5/2015 | Faehnle | F25D 23/126 62/126 |

* cited by examiner

*Primary Examiner* — Patrick M Buechner
(74) *Attorney, Agent, or Firm* — Dority & Manning, P.A.

(57) ABSTRACT

A dispenser assembly configured to dispense liquids or solids from an appliance. In one embodiment, the dispenser assembly includes a tray, a plunger located above the tray, and a discharge opening. The plunger has a front surface and is moveable between a non-dispensing position and a dispensing position. The discharge opening is concealed behind the plunger and free of the path of the plunger from the non-dispensing position to the dispensing position.

17 Claims, 4 Drawing Sheets

APPARATUS FOR DISPENSING LIQUIDS AND SOLIDS

BACKGROUND OF THE INVENTION

1. Field of the Invention

The subject matter disclosed herein relates to refrigerators or other appliances, and more particularly, to liquid and solid dispensers for appliances.

2. Description of Related Art

Appliances, such as refrigerators, can include a liquid and/or solid dispenser e.g. water and/or ice dispenser) that extends through a wall or door of the appliance in order to deliver liquids and/or solids from a space, such as a refrigerated space, inside the appliance to a user's container outside the appliance. In the case of a solid dispenser in the form of an ice dispenser, an ice bin is typically provided inside the appliance that receives and stores ice cubes, such as are formed and frozen by an icemaker. The ice is transferred through a chute to a discharge opening, where the ice can be delivered to the user's container. In the case of a liquid dispenser (e.g. a water dispenser), a liquid is provided by a connection to a liquid supply. The liquid is delivered from the liquid supply through a liquid line to a liquid discharge opening.

To activate the dispenser and dispense a liquid, and/or a solid, a plunger can be depressed, e.g., by pushing a drinking container against the plunger. To deactivate the dispenser and stop dispensing the liquid and/or the solid, force is removed from the plunger and the plunger is allowed to move into its resting, non-dispensing position.

Dispensers also include a tray to catch residual liquids or solids dripping, leaking, or spilling from the liquid discharge opening or the solid discharge opening. The tray, as well as the plunger, can become regularly wet with use. When the liquid dries, mineral deposits and/or other stains remain on the tray or the plunger, looking unsightly and messy. Additionally, the dispensers themselves can be considered unsightly as compared to the otherwise sleek external surface of the front door.

It would be advantageous to provide a liquid and/or solid dispenser for a refrigerator or other appliance, without the unsightly appearance of liquid stains and the other disadvantages of dispensers, as described above.

BRIEF DESCRIPTION OF THE INVENTION

A liquid and/or solid dispenser, which is discussed in more detail below, reduces or eliminates the unsightly appearance of an appliance and the dispenser by concealing liquid stains and mineral deposits on various components of the appliance or the dispenser. The present dispenser also improves upon the aesthetic quality of an appliance with a dispenser by reducing the noticeability or obviousness of the dispenser, providing the appearance that the from of the dispenser blends into the front surface of the appliance.

In one embodiment, the dispenser of liquids or solids for an appliance comprises a tray, a plunger located above the tray, and a discharge opening. The plunger has a front surface, a non-dispensing position, and a dispensing position. The discharge opening is concealed behind the plunger and free of the path of the plunger from the non-dispensing position to the dispensing position.

In another embodiment, an appliance for dispensing liquids or solids is provided. The appliance comprises an opening in an exterior surface of the appliance and a dispenser positioned in and through the opening in the exterior surface of the appliance. The dispenser comprises a tray in the opening and a plunger located above the tray in the opening. The tray has a basin, at least one support element for supporting a container, and a front surface positioned flush with the exterior surface of the appliance. The plunger has a front surface, a non-dispensing position, and a dispensing position, wherein in the non-dispensing position the front surface of the plunger is flush with the exterior surface of the appliance.

In yet another embodiment, a dispenser for an appliance is provided. The dispenser comprises a plunger having a non-dispensing position and a dispensing position, and a tray located below the plunger. The tray has a top surface and a basin below the top surface. The basin is deeper than the longest dimension of an entire solid dispensed from the dispenser so the entire solid is held below the top surface of the tray.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION OF THE INVENTION

Figure 1:
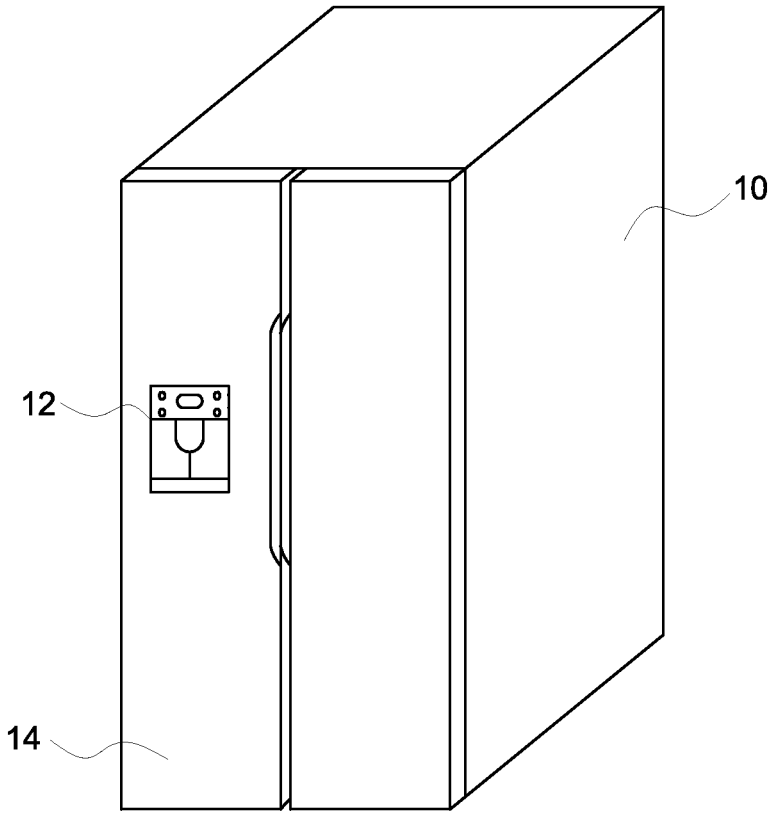
FIG. 1 is a perspective view of an exemplary embodiment of an appliance with a liquid and/or solid dispenser.

FIG. 1 depicts a perspective view of an exemplary embodiment of an appliance 10, which is shown as an upright, side-by-side refrigerator with side-by-side refrigeration and freezer compartments. It is contemplated, however, that at least some of the benefits of various embodiments recited herein can be realized in other types of appliances, such as top-mount and bottom-mount refrigerators, or other appliances capable of utilizing liquid and/or solid dispensers. Accordingly, embodiments of the invention are therefore not intended to be limited to only the configuration and features of the exemplary upright, side by side refrigerator. In the embodiments herein described the liquid dispensed is water and the solid dispensed is ice which may be dispensed as formed pieces or as crushed ice. The formed ice pieces are referred to herein generically as ice cubes, however, it is to be understood that the shape of the ice pieces may, but need not, be cubic, but may be for example, cylindrical or semi-cylindrical or any other suitable geometric shape. The particular shape and dimensions will be determined by the configuration of the icemaker.

The appliance 10 comprises a dispenser assembly 12 that is configured to dispense water and ice. The dispenser assembly 12 is positioned in a front door 14 of the appliance 10, wherein the front face of the dispenser assembly 12 is flush with the front surface of the front door 14. In this position the dispenser assembly 12 extends from the front face of the front door 14 toward the rear of the appliance 10. As used herein, the term "flush" describes one or more configurations of the dispenser assembly 12 in which the front face 16 is even, level, and/or on the same plane, whether the plane is flat or curved. This definition is used throughout the discussion below to describe embodiments of the dispenser assembly 12 as well as its various parts, elements, and components.

Figure 2:
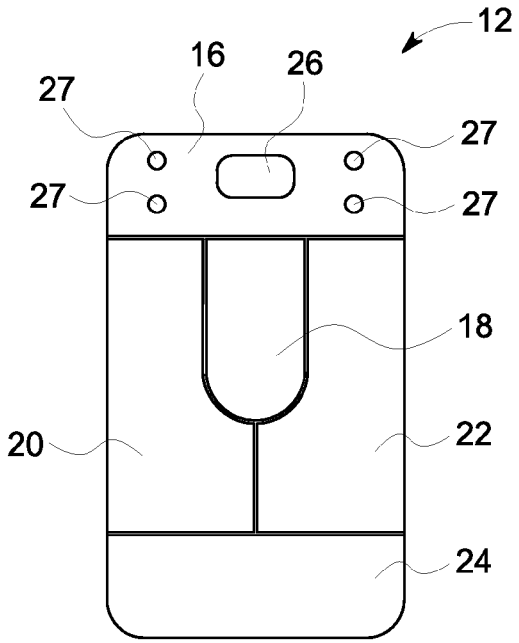
FIG. 2 is a front view of an exemplary embodiment of a liquid and/or solid dispenser in a non-dispensing state.
Figure 3:
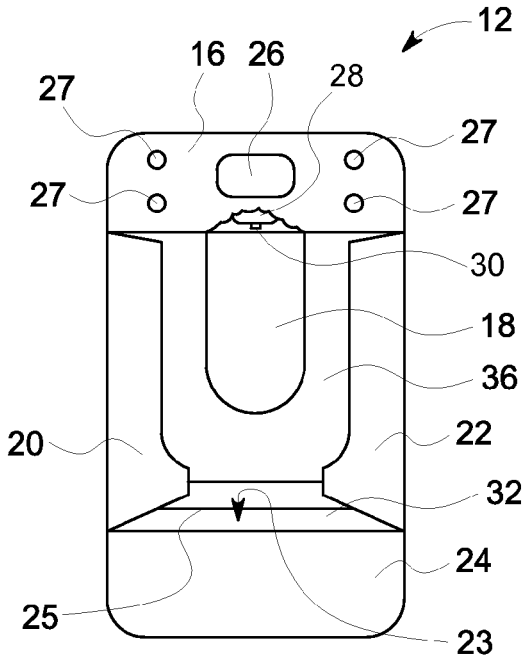
FIG. 3 is a front view of the liquid and/or solid dispenser of FIG. 2 in a dispensing state.

Focusing on the dispenser assembly 12, and with reference to FIGS. 2 and 3, FIG. 2 is a front view of an exemplary embodiment of the dispenser assembly 12 in a non-dispensing state. The dispenser assembly 12 has a control panel 16, a plunger 18 with a non-slip coating 19, a first dispenser door 20, a second dispenser door 22, and a tray 24. The control panel 16 is flush with the front surface of the front door 14 and is located above the plunger 18, the first dispenser door 20, and the second dispenser door 22. In other embodiments, the control panel 16 can be positioned alternatively with respect to the plunger 18 and the dispenser doors 20, 22.

The control panel 16 has a display 26 and selection buttons 27, which can be used to activate and to select between settings for the dispenser assembly 12 and/or the appliance 10 generally. Examples of these settings include, but are not limited to, water or ice settings (e.g. water, cubed ice, crushed ice, etc.) and temperature settings such as to adjust the temperature of the refrigeration compartments. An indication such as for the selected setting is provided to the end user via the display 26.

In the non-dispensing state, the plunger 18 is positioned in its non-dispensing position, flush with the surface of the front door 14. The first dispenser door 20, the second dispenser door 22, and the tray 24 are also positioned flush with the surface of the front door 14. In one embodiment, the front surfaces of the control panel 16, the plunger 18, the dispenser doors 20, 22, the tray 24, and the surface of front door 14 fit together congruently at each part's respective edges, thereby on the one hand minimizing the gap between the respective edges of these parts but also providing sufficient space on as to effectuate operation of the parts as described below. Moreover, the flush positioning and the close fit of the control panel 16, the plunger 18, the dispenser doors 20, 22, the tray 24, and the front surface of the front door 14 will better assimilate the dispenser assembly 12 into the construction of, e.g., the front door 14. This configuration improves the appearance of the appliance 10 such as by substantially reducing interruptions in the continuity of the front surface of the front door 14. When implemented, these features will make the dispenser assembly 12 less conspicuous and, ultimately, more aesthetically pleasing to an end user of the appliance 10 and the dispenser assembly 12.

As depicted in FIG. 2, at the front surface of the plunger 18, the dispenser doors 20, 22 meet and bound the bottom and side edges of the plunger 18. The dispenser doors 20, 22 also share a border, which is located directly above and extends substantially horizontal with the tray 24. In an alternative embodiment, the plunger 18 extends to the tray 24 and also shares a border directly above the tray 24. Still other alternatives are contemplated in which the control panel 16, the plunger 18, the dispenser doors 20, 22, and the tray 24 are flush with the front surface of the appliance 10 and configured to minimize the gap and/or space between the borders of the components.

FIG. 3 is a from view of the dispenser assembly 12 in a dispensing state in which is now visible a housing 36. As clearly seen in the cutaway section located at the top of the dispenser assembly 12, the ice discharge opening 28 and a water discharge opening 30, both are recessed above and behind the plunger 18, and behind the control panel 16. This location prevents the discharge openings 28 and 30 from obstructing the motion of the plunger 18 such as between the non-dispensing state and the dispensing state. Being above and behind the plunger 18, the discharge openings 28 and 30 are concealed from view. To be concealed from view means to have sight obstructed. In some embodiments, in which the close, congruent fit of the control panel 16 and the plunger 18 allows no line of sight to the discharge openings 28, 30, the discharge openings 28, 30 are completely concealed (e.g. completely hidden) from view. However, in some embodiments, the close, congruent fit of the control panel 16 and the plunger 18 allows a minimal view, or allows a minimal view at angles awkward and unusual from the perspective of a user of the refrigerator standing in front of the refrigerator. In these embodiments that allow a minimal view, the discharge openings 28, 30 are mostly concealed.

In one embodiment, the ice discharge opening 28 comprises a chute (not shown), through which travel crushed ice and cubed ice from an ice maker (not shown) located inside of the appliance 10. The water discharge opening 30 comprises a tube (not shown) that in one example is smaller than the chute and located in front of the chute (e.g., closer to the front surface of the dispenser assembly 12). This tube is configured to dispense water.

To place the dispenser assembly 12 in the dispensing state, the plunger 18 is pressed into the dispenser assembly 12 and/or toward the back of the housing 36 by the user, for example by pressing a glass or other container against the plunger and progressively into the housing 36. A spring or another similar mechanism can be provided to apply a force that resists movement of the plunger 18 from its non-dispensing position to its dispensing position. The amount of this force is selected, so as to be easily overcome by the end user pushing against the plunger 18 with the glass or container. The dispenser doors 20, 22 swing open inwardly, which enlarges the opening below the solid discharge opening 28 and the liquid, discharge opening 30. This opening is sufficient to position a container in the dispenser assembly 12 to receive water or ice. In the embodiments illustrated schematically in FIGS. 2 and 3, the dispenser doors 20, 22 are pivotally coupled to the housing 36 and/or portion of the dispenser assembly 12, so they can rotate inwardly when the dispenser assembly 12 is actuated from the non-dispensing state to the dispensing state, and biased by a suitably arranged spring or other biasing means for return to the non-dispensing state when released from the dispensing state such as by removal of the glass or container from engagement with plunger 18.

The ice discharge opening 28 and the water discharge opening 30 are disposed closer to the front of the dispenser assembly 12 than the rear of the dispenser assembly 12 so as to minimize the distance the plunger 18 needs travel to clear the area below the discharge openings 28, 30 for the glass or container to be positioned to catch the ice or water. In one embodiment, the front of the ice discharge opening 28 and the front of the water discharge opening 30 are closely adjacent the front surface of the appliance 10. In other embodiments with the discharge openings 28, 30 positioned deeper toward the back of the dispenser assembly 12, the plunger 18 can be adjusted to push deeper into the dispenser assembly 12 and/or toward the back of the housing 36. The forward position of the discharge openings 28, 30 helps create distance between the discharge openings 28, 30 and the plunger 18 in the dispensing state, which helps prevent or reduce liquid from dripping or splashing onto the plunger 18, and helps reduce associated liquid deposits on the plunger 18.

Because the contour of the front surface of the plunger 18 is shaped to conform to the front surface of the appliance (e.g.

with a substantially vertical planar surface), and because the plunger 18 moves from the non-dispensing state to the dispensing state along a substantially linear axis and/or in a direction substantially perpendicular to the face of the plunger or the front of the appliance, with proper selection of the dispensing position, that is the position of the plunger that actuates the dispensing of ice or water, the plunger 18 is clear of the travel path of discharged ice or water as it exits from the respective discharge opening 28, 30 and falls downward. This feature also reduces the chance that unsightly liquid stains and mineral deposits will build on the plunger 18. Even if liquid stains or mineral deposits occur on the plunger 18 or the dispenser doors 20, 22, the single visible smooth front surface of each of the plunger 18 and the dispenser doors 20, 22, e.g., in the non-dispensing state, are more easily cleaned than the multiple, more-intricate, visible surfaces of each of the plungers, trays, and other components of existing dispenser assemblies.

Referring back to FIG. 3, the tray 24 has a basin 23 to catch water and/or ice and support elements 25 that extend across the basin 23 in a plane substantially perpendicular to the front surface of the appliance 10 or dispenser assembly 12. The basin 23 acts as a sump that receives and retains water or ice not caught by the glass or container. Typically, such water and ice is a relatively small amount that accumulate in the basin 23 will evaporate over time. Alternatively, the tray 24 is removable so the end user can remove the tray 24, empty the tray 24, and replace the tray 24 back in position in the dispenser assembly 12.

The depth of the tray 24 and the basin 23 is enlarged when the dispenser assembly 12 is equipped to dispense ice. In one example, the basin 23 is deep enough so a whole ice cube, is received and held below the top level of the tray 24 regardless of the orientation of the ice cube. The basin 23 is also wide enough from side to side and from front to back so that multiple ice cubes can be held in the basin 23 side by side. For example, in one embodiment, the tray 24 and the basin 23 are about 8 inches (20.32 cm) wide from side to side, about 4 inches (10.16 cm) wide, from front to back, and about 2 inches (5.08 cm) deep from top to bottom. In an alternative embodiment, the basin 23 can be even deeper so that the basin 23 is deep enough to collect multiple layers of cubes such as stacked one on top of the other and still hold the cubes below the top level of the tray 24. Allowing stray solids to fall into the basin 23 that holds the solids below the top level of the tray 24 prevents or reduces the chance that the ice cubes will obstruct movement of the dispenser doors 20, 22 between, e.g., the dispensing state and the non-dispensing state. The enlarged volume of the basin 23 due to increased width and/or depth also allows a greater amount of water and/or ice to be held, which reduces the need to empty the tray 24.

The support elements 25 provide support for a drinking glass or other container to allow a user to rest a container in the dispenser assembly 12 without the container falling into the basin 23. In one embodiment, the support elements 25 are spaced widely enough for an entire ice cube, to fit past the support elements 25 and fall into the basin 23, so the cube cannot sit on the top of the support elements 25 to obstruct the motion of the dispenser doors 20, 22 or the plunger 18. In one example, the support elements 25 are spaced at least 2 inches (5.08 cm) on either side from an adjacent one of the support element 25 or the side, back, or front of the tray 24. In another embodiment, the support elements 25 are recessed downward toward the bottom of the basin 23. In this configuration, spacing of the support elements 25 is less critical because the depth of the recessed support elements is such that even if cubes are held by the support elements 25 they are sufficiently below the top surface of the tray 24 so as not to obstruct movement of the plunger 18 and the dispenser doors 20, 22 between the dispensing state and the non-dispensing state.

Figure 4:
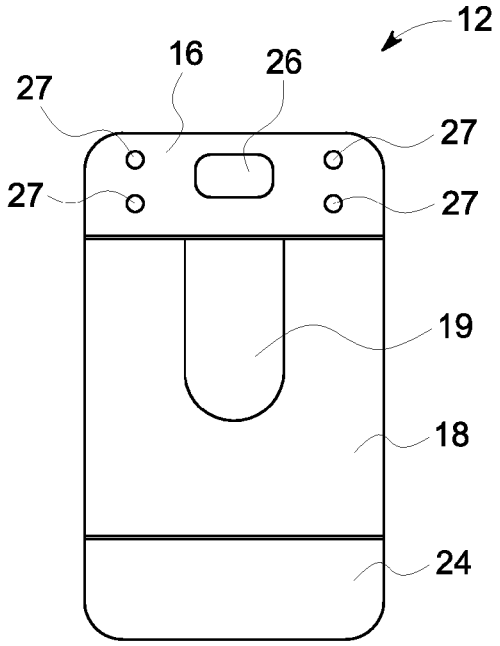
FIG. 4 is a front view of another exemplary embodiment of a liquid and/or solid dispenser in a non-dispensing state.
Figure 5:
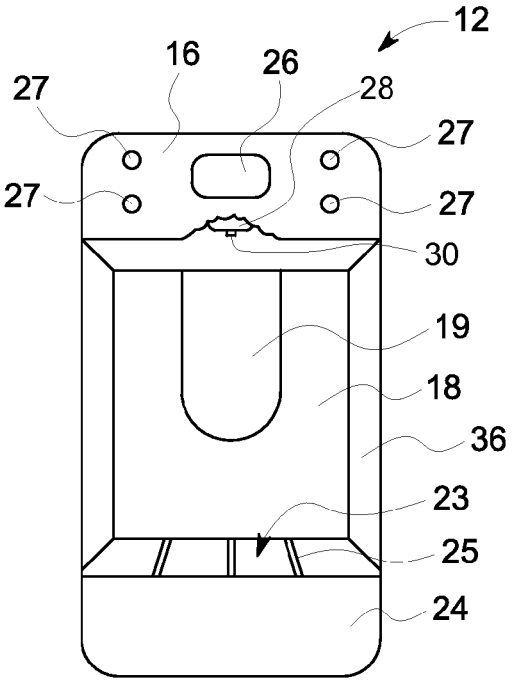
FIG. 5 is a front view of the liquid and/or solid dispenser of FIG. 4 in a dispensing state.

FIGS. 4 and 5 illustrate a front view of another exemplary embodiment of a dispenser assembly 12 in a non-dispensing state (FIG. 4) and a dispensing state (FIG. 5). In this embodiment, there are no doors (e.g., the dispenser doors 20, 22 of FIGS. 1 and 2) separate from the plunger 18, but rather the plunger 18 covers the entire front opening of the dispenser assembly 12. A non-slip coating 19 is applied to the center of the plunger 18 where a user will press a container against the plunger 18 in order to create a non-slip surface 19. The plunger 18 in the non-dispensing state rests flush with the surface of the front door 14, directly below the control panel 16 and directly above the tray 24. The plunger extends from side to side to cover the entire front opening of the dispenser.

The front surfaces of the control panel 16, the plunger 18, the tray 24, and the front door 14 can fit together congruently at each part's respective edges to minimize the space or gap between the parts but providing sufficient clearance for the plunger 18 to operate as described below. A housing 36 (see FIG. 5) can also be included as part of the dispenser assembly 12, in which case, the front surfaces of the control panel 16, the plunger 18, the tray 24, and the housing 36 (see FIG. 5) can fit together congruently at each part's respective edges. The flush positioning and the close fit of the control panel 16, the plunger 18, the tray 24, and the front surface of the front door 14 lessen the appearance of an interruption in the front surface of the front door 14. In this configuration the dispenser assembly 12 is less conspicuous and/or less noticeable.

FIG. 5 is a front view of the liquid, and/or solid dispenser of FIG. 4 in a dispensing state. As with the embodiment illustrated in FIGS. 2 and 3, in the dispensing state, the plunger 18 is pressed into the dispenser assembly 12 and/or toward the back of the housing 36 to a dispensing position. A spring or another similar mechanism applies a force to resist moving the plunger 18 into the dispensing position. The resistive force is easily overcome by a user pushing against the plunger 18, for instance, with a drinking glass or another container.

Seen in the cutaway section of FIG. 5, as with the embodiment depicted in FIGS. 2 and 3, the ice discharge opening 28 and the water discharge opening 30 are recessed above the plunger 18, behind the control panel 16. Crushed or cubed ice, can be dispensed through the ice discharge opening 28, while water can be dispensed through the water discharge opening 30. Being recessed above the control panel prevents the discharge openings 28 and 30 from obstructing the motion of the plunger 18 as it moves between the non-dispensing state and the dispensing state.

As in the embodiment of FIGS. 2 and 3, ice discharge opening 28 and the water discharge opening 30 are also closer to the front of the dispenser assembly 12 than the rear of the dispenser assembly 12 so that the plunger 18 need not be pushed far to clear the area below the discharge openings 28, 30 facilitating placement of the glass or container below the discharge openings 28, 30 to catch water and/or ice. Otherwise, the plunger 18 can be adjusted to push deeper into the dispenser assembly 12 and/or toward the back of the housing 36. The forward position of the discharge openings 28, 30 helps create distance between the discharge openings 28, 30 and the plunger 18 in the dispensing state, which helps prevent or reduce dripping or splashing onto the plunger 18, and helps reduce associated stains and mineral deposits on the plunger 18.

Because the front surface of the plunger 18 is shaped like the front surface of the appliance (e.g. with a substantially vertical surface), and because the plunger 18 moves from the non-dispensing position to the dispensing position along a substantially linear axis and/or in a direction substantially perpendicular to the face of the plunger or the front of the appliance, in its dispensing position, the plunger is clear from the normal line of motion of a liquid or a solid as it is dispensed from the respective discharge opening 28, 30 and caused to fall downward by gravity. This feature also reduces the chance that unsightly liquid stains and mineral deposits will build on the plunger 18. Even if liquid stains or mineral deposits occur on the plunger 18, the smooth front surface of the plunger 18 is more easily cleaned than the multiple, more-intricate surfaces of plungers, trays, and other components of existing dispenser assemblies.

Also seen in FIG. 5 is the tray 24, which is as described above with respect to FIGS. 2 and 3. The plunger 18 and/or the dispenser doors 20, 22, being flush with the front surface of the front door 14, conceal the top surface of the tray 24, the support elements 25 of the tray 24, the basin 23, and the discharge openings 28, 30. Any unsightly appearance of liquid stains or mineral deposits forming on the tray 24, the support elements 25 of the tray 24, the basin 23, or the discharge openings 28, 30 are hidden from view in the non-dispensing state.

Figure 6:
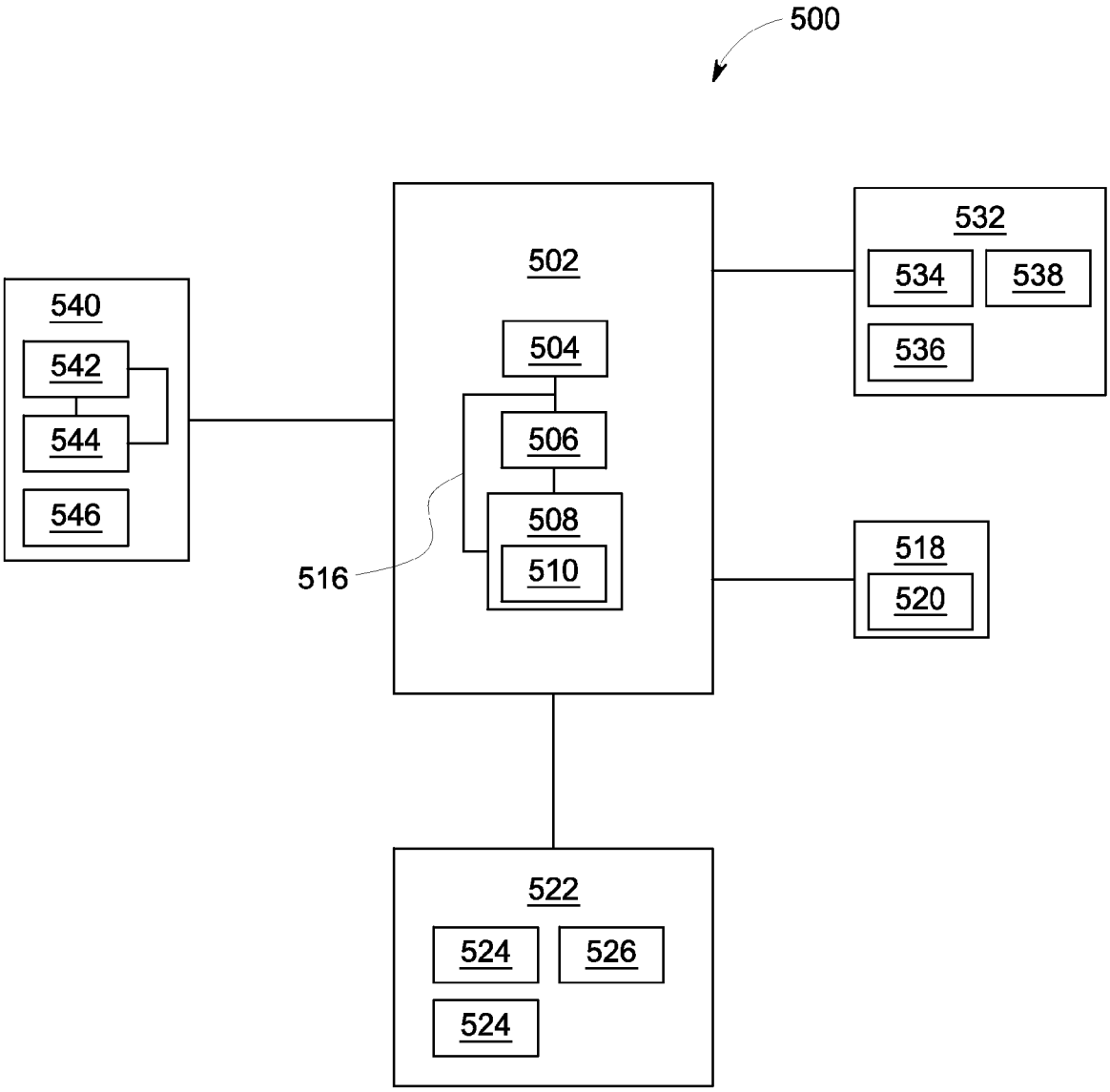
FIG. 6 is a schematic diagram of an example of a control system for use with an appliance and a liquid and/or solid dispenser such as the liquid and/or solid dispensers of FIGS. 1, 2, 3, 4, and 5.

A variety of control configurations and schemes can be used to effectuate dispensing of the liquid and/or solid and actuation of the dispenser doors 20, 22. FIG. 6 is a schematic diagram exemplifying one of the variety of control systems for use with appliances, such as the appliance of FIG. 1, the dispenser assemblies of FIGS. 2-5, as well as related embodiments. Referring to FIG. 6, the control system 500 comprises a controller 502, which can further comprise a processor 504, a memory 506, and control circuitry 508 configured for controlling operation of the dispenser assembly as well as the general operation of appliance 10. These components are coupled and communicate with one another when applicable via one or more busses 516. Control system 500 further comprises a dispenser assembly control 540, which further includes a first activator 542, a solenoid 544, and a second activator 546 for controlling the movement of the dispenser doors and dispensing of ice and water. In one embodiment, a delay circuit 510 can be employed as part of the control circuitry 508 to delay the plunger 18 and/or the dispenser doors 20, 22 from returning to rest in the non-dispensing position.

In the embodiment of FIG. 6, the control system 500 comprises a flow control device 518 responsive to controller 502, which includes one or more valves 520 that control the flow of water in the ice and water dispenser of appliance 10. The controller 502 is operatively coupled to a control panel 522. The control panel 522 comprises one or more dispense selection controls 524 and an indicator control 526. The controller 502 effectuates operation of various elements of the appliance 10 consistent with inputs from the control panel 522 and in response to activation of the water or ice dispensing function.

Configurations of the controller 502 include one or more groups of electrical circuits that are each configured to operate, separately or in conjunction with other electrical circuits, the fluid dispensing function of appliance 10. The controller 502 and its constructive components are configured to communicate amongst themselves and/or with other circuits (and/or devices), which execute high-level logic functions, algorithms, as well as firmware and software instructions. Exemplary circuits of this type include, but are not limited to, discrete elements such as resistors, transistors, diodes, switches, and capacitors, as well as microprocessors and other logic devices such as field programmable gate arrays ("FPGA's") and application specific integrated circuits ("ASICs"). While all of the discrete elements, circuits, and devices function individually in a manner that is generally understood by those artisans that have ordinary skill in the electrical arts, it is their combination and integration into functional electrical groups and circuits that generally provide for concepts that are disclosed and described herein.

The electrical circuits of the controller 502 are sometimes implemented in a manner that can physically manifest logical operations, which are useful to facilitate various operations such as opening and closing the dispenser doors 20, 22 and actuating the dispensing of ice and water. The electrical circuits can replicate in physical form an algorithm, a comparative analysis, and/or a decisional logic tree, each of which operates to assign the output and/or a value to the output that correctly reflects one or more of the nature, content, and origin of the changes that occur and that are reflected by the relative inputs, e.g., from sensors that monitor the position of the plunger, to the solenoid 544 actuating the dispenser doors 20, 22.

In one embodiment, the processor 504 is a central processing unit (CPU) such as an ASIC and/or an FPGA that is configured to control operation of the solenoid 544 actuating the dispenser doors 20, 22. The processor 504 can also include state machine circuitry or other suitable components capable of controlling operations. The memory 506 includes volatile and non-volatile memory and can be used for storage of software (or firmware) instructions and configuration settings. The control circuitry 508 can be embodied as multiple stand-alone components such as solid-state devices. These devices can be mounted to substrates such as printed circuit boards, which can accommodate various components including the processor 504, the memory 506, and other related circuitry to facilitate operation of the controller 502 in connection with its implementation in the appliances.

However, although FIG. 5 shows the processor 504, the memory 506, and the control circuitry 508 as discrete circuitry and combinations of discrete components, this need not be the case. For example, one or more of these components can be contained in a single integrated circuit (IC) or other component. As another example, the processor 504 can include internal program memory such as RAM and/or ROM. Similarly, any one or more functions of these components can be distributed across additional components (e.g., multiple processors or other components).

Referring to FIGS. 2 and 3 and to the control system 500 of FIG. 6, exemplary operation an implementation of the dispenser assemblies of the present disclosure is now described. To dispense a liquid or a solid, a user presses the plunger 18 inwardly with a glass or other container toward the back of the dispenser assembly 12, thereby moving the plunger from its non-dispensing position to its dispensing position. The non-slip surface or non-slip coating 19 provides better friction between the plunger 18 and the container to make pressing on the plunger 18 easier. The plunger 18 is mechanically connected to a first activator 542, which is a switch that is triggered by the linear motion (i.e., movement and/or movement to a predetermined position) of the plunger 18. The first activator 542 is configured to trigger upon the first movement of the plunger 18 from the non-dispensing state toward the dispensing state. Activator 542, when triggered, enables the solenoid 544 to be energized. The solenoid 544 is mechanically connected to the dispenser doors 20, 22, so that when the solenoid 544 is energized, it actuates the rotation of the dispenser doors 20, 22 so the dispenser doors 20, 22 swing open. The plunger 18 can also be connected to the solenoid 544, so that the solenoid 544 imparts motion to the plunger 18 automatically once the end user moves the plunger 18 an initial distance to trigger the second activator 542.

The plunger 18 is also mechanically linked with a second activator 546, which is also triggered by the linear motion of the plunger 18. The second activator 546 is configured to trigger when the plunger 18 reaches its dispensing position, which is at a point during the motion of the plunger 18 after the first activator 542 triggers. This point is selected to initiate the dispensing of water or ice when the glass or container is positioned to receive the water or ice. In the embodiments herein described, the dispensing position is selected to correspond with a drinking glass or another container pressed against the plunger 18 being approximately centered under the discharge openings 28 and 30. In this embodiment, the plunger is manually depressed such as by engagement with the glass or container to trigger the second activator 546.

In another embodiment, the second activator 546 is a proximity sensor in the form of an optical sensor with an emitter and a detector aligned to send signals through the space where a container will collect dispensed fluids and/or solids. The optical sensor is triggered when a container is positioned to disrupt the signals sent from the emitter from being received by the detector. In this embodiment, the plunger 18 can be automatically moved by the solenoid 544, which is energized after triggering of the second activator 542. The second activator 542 can be energized by initially pressing on the plunger 18.

When the user removes the container, the plunger 18 moves from the dispensing position to the non-dispensing position with a delay. For instance, when the second activator 546 is a switch and the plunger 18 is not connected to the solenoid 544, then when the plunger 18 moves from the dispensing position, that is, the point where the first activator 546 was triggered, the first activator 546 is released, which deactivates the dispensing of water or ice. A mechanical damper can halt or slow the movement of the plunger 18 to create a delay in the movement toward the non-dispensing position. When the plunger 18 moves past the point where the first activator 542 was triggered, the first activator 542 is released, which deactivates the solenoid 544, allowing the dispenser doors 20, 22 to close. The dispenser doors 20, 22 are also spring-loaded, or otherwise configured to have a tension forcing the dispenser doors 20, 22 into the closed position associated with the non-dispensing state. Movement of the dispenser doors 20, 22 and the plunger 18 to the closed, non-dispensing positions, hides the tray 24, the basin 23, the support elements 25 of the tray 24, the discharge openings 28 and 30.

Alternatively, when activator 546 is an optical sensor, then when the container is removed and the transmission of the signals from the emitter to the detector is restored, the dispenser assembly 12 stops dispensing liquids or solids. The restoration of the optical signal triggers the delay circuit 510. The delay circuit 510 initiates a delay in the movement of the plunger 18 toward the non-dispensing position, by delaying the deactivation of the solenoid 544. When the solenoid 544 is deactivated, springs force the dispenser doors 20, 22 and the plunger 18 into the closed and non-dispensing positions respectively. The movement of the plunger 18 can be suspended in a number of alternative methods. The delay allows any residual dripping of liquid from the solid discharge opening 28 or the liquid discharge opening 30 to cease before passing under the discharge openings 28, 30 where liquid might drip onto the front surface of the plunger 18.

The operation of the embodiment depicted in FIGS. 4 and 5 is similar to the operation described above for the embodiment depicted in FIGS. 2 and 3, but for operations or features related to the dispenser doors 20, 22. Referring to the embodiment depicted in FIGS. 4-5 and the control system described with respect to FIG. 6, the operation of the dispenser is now described. To dispense a liquid or a solid, a user presses the plunger 18 inwardly with a glass or other container toward the back of the dispenser assembly 12. The non-slip surface or non-slip coating 19 provides better friction between the plunger 18 and the container to make pressing on the plunger 18 easier.

The plunger 18 is depressed manually. The plunger 18 is mechanically connected to activator 546, which is triggered by the movement of the plunger 18 to its dispensing position. As described with reference to the embodiment of FIGS. 2 and 3, in this embodiment, the activator 546 is a switch configured to trigger at a point during the motion of the plunger 18 when a drinking glass or another container pressed against the plunger 18 is approximately centered under the solid discharge opening 28 and the liquid discharge opening 30. The activator 546, when triggered, enables the activation of the dispenser assembly 12 to dispense liquids or solids, depending on the selection selected by a user using the control panel 522.

When the user removes the container, the plunger 18 moves from the dispensing position toward the non-dispensing position, with a delay. When the plunger 18 moves from the point where the activator 546 was triggered, the activator 546 is released, which deactivates the dispensing of water or ice. A mechanical damper institutes a delay before the plunger 18 continues to the non-dispensing position.

In another embodiment, after initial movement by the user using a glass or container or otherwise, the plunger 18 is moved to its dispensing position by the solenoid 544, is energized by actuation of first activator 542. Dispensing of the water or ice is then actuated by second activator 546 in the form of an optical proximity sensor. In this embodiment, the initial movement of the plunger 18 triggers the first activator 542, which is a switch, to energize the solenoid 544, which in turn, powers the further movement of the plunger 18 into the dispensing position. A container being positioned under the discharge openings 28, 30 interrupts transmission of signals from the emitter to the detector of the optical sensor. This interruption of the signals initiates dispensing of ice or water, depending on the settings of the control panel 16.

When the container is removed and the transmission of the signals from the emitter to the detector is restored, the dispenser assembly 12 stops dispensing water or ice. The restoration of the optical signal triggers the delay circuit 510. The delay circuit 510 initiates a delay in the movement of the plunger 18 toward the non-dispensing state, by delaying the deactivation of the solenoid 544. The delay allows any residual dripping of liquid from the solid discharge opening 28 or the liquid discharge opening 30 to cease before passing under the discharge openings 28, 30 where liquid might drip onto the front surface of the plunger 18. When the solenoid 544 is deactivated, springs force the plunger 18 into the non-dispensing position. Movement of the plunger 18 to the closed, non-dispensing position, hides the tray 24, the basin 23, the support elements 25 of the tray 24, the solid discharge opening 28, and the liquid discharge opening 30, all of which accumulate unsightly liquid stains and mineral deposits.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A dispenser assembly for an appliance, the dispenser assembly comprising:

a tray;

a plunger located above the tray and moveable between a non-dispensing position and a dispensing position, wherein the plunger is configured so that a front surface of the plunger is substantially flush with a front surface of a front door of the appliance when the plunger is in the non-dispensing position; and a dispenser door located above the tray, wherein the dispenser door has a front surface and is configured to move between a closed position and an open position, and wherein in the closed position the front surface of the dispenser door is substantially flush with the front surface of the front door of the appliance, and in the open position the front surface of the dispenser door is recessed relative to the front surface of the front door of the appliance.

2. The dispenser assembly of claim 1, further comprising:

a dispenser housing with a front opening through an exterior surface of the appliance, wherein the front surface of the plunger is configured to cover the front opening of the dispenser housing, and wherein the plunger is moveable between the non-dispensing position and the dispensing position along a linear axis substantially perpendicular to the front surface of the front door of the appliance.

3. The dispenser assembly of claim 1, wherein movement of the plunger from the non-dispensing position to the dispensing position initiates movement of the dispenser door from the closed position to the open position.

4. The dispenser assembly of claim 1, wherein the discharge opening is positioned at the front of the dispenser assembly.

5. The dispenser assembly of claim 1, wherein the tray comprises a basin, the basin being deeper than the longest dimension of a solid dispensed from the discharge opening.

6. The dispenser assembly of claim 1, wherein at least a portion of the front surface of the plunger has a non-slip surface.

7. The dispenser assembly of claim 1, further comprising a delay mechanism configured to delay movement of the plunger from the dispensing position to the non-dispensing position.

8. The dispenser assembly of claim 1, further comprising a discharge opening concealed behind the plunger relative to the front surface of the front door of the appliance when the plunger is in the non-dispensing position and positioned so as to not interfere with movement of the plunger as the plunger moves between the non-dispensing position and the dispensing position.

9. An appliance, comprising:

an appliance door comprising an outer surface in which an opening is formed;

a dispenser assembly positioned in the opening, the dispenser assembly comprising a tray, and a plunger located above the tray, wherein the plunger comprises a front surface and is configured to move between a non-dispensing position and a dispensing position, and wherein in the non-dispensing position the front surface of the plunger is substantially flush with a front surface of a front door of the appliance; and a dispenser door located above the tray in the opening, wherein the dispenser door is configured to move between a closed position and an open position, and wherein in the closed position a surface of the dispenser door is substantially flush with the front surface of the front door of the appliance, and in the open position the surface of the dispenser door is recessed relative to the front surface of the front door of the appliance.

10. The appliance of claim 9, wherein the plunger moves from the non-dispensing position to the dispensing position along a linear axis substantially perpendicular to the front surface of the front door of the appliance.

11. The appliance of claim 9, wherein the tray, the plunger, and the surface of the appliance door fit together congruently at all edges.

12. The appliance of claim 9, wherein the dispenser door, the tray, the plunger, and the surface of the appliance door fit together congruently at all edges.

13. The appliance of claim 9, wherein movement of the plunger from the non-dispensing position to the dispensing position initiates movement of the dispenser door from the closed position to the open position.

14. The appliance of claim 9, wherein the tray comprises a basin, and wherein the basin is deeper than the longest dimension of a solid that is dispensed from the discharge opening, thereby holding the solid below the surface of the tray.

15. The dispenser assembly of claim 9, further comprising a delay mechanism configured to delay movement of the plunger from the dispensing position to the non-dispensing position.

16. The dispenser assembly of claim 9, further comprising a discharge opening recessed above the opening in the surface of the appliance door, wherein the discharge opening is concealed by the plunger relative to the front surface of the front door of the appliance when the plunger is in the non-dispensing position.

17. A dispenser assembly for an appliance, the dispenser assembly comprising:

a tray;

a plunger located above the tray and moveable between a non-dispensing position and a dispensing position;

a discharge opening concealed behind the plunger relative to a front surface of a front door of the appliance when the plunger is in the non-dispensing position and positioned so as to not interfere with movement of the plunger as the plunger moves between the non-dispensing position and the dispensing position; and a dispenser door located above the tray, wherein the dispenser door has a front surface and is configured to move between a closed position and an open position, and wherein in the closed position the front surface of the dispenser door is substantially flush with the front surface of the front door of the appliance, and in the open position the front surface of the dispenser door is recessed relative to the front surface of the front door of the appliance.

* * * * *